US007497348B2

(12) United States Patent
Johnson et al.

(10) Patent No.: US 7,497,348 B2
(45) Date of Patent: Mar. 3, 2009

(54) ADAPTER FOR PAINT MIXERS

(75) Inventors: Benjamin M. Johnson, Coon Rapids, MN (US); Aaron Curtis, Eagan, MN (US); Thomas J. Midas, Oak Park Heights, MN (US)

(73) Assignee: Red Devil Equipment Company, Plymouth, MN (US)

( * ) Notice: Subject to any disclaimer, the term of this patent is extended or adjusted under 35 U.S.C. 154(b) by 473 days.

(21) Appl. No.: 11/304,114

(22) Filed: Dec. 15, 2005

(65) Prior Publication Data

US 2007/0140049 A1 Jun. 21, 2007

(51) Int. Cl.
*B44D 3/08* (2006.01)
*B44D 3/14* (2006.01)
*B01F 15/00* (2006.01)

(52) U.S. Cl. ..... 220/4.22; 220/324; 220/737; 366/110; 366/209; 366/605

(58) Field of Classification Search ..... 366/208, 366/209, 110, 202, 211, 605; 24/591.1–598.1, 24/616, DIG. 8–60, 375, 572.1–702; 403/329, 403/DIG. 4, 379.2, 381; 202/305, 323, 324, 202/326, 829, 833, 837, 838, 840, 847; 292/87, 292/593.1, 594.11, 596.1, DIG. 61; 206/485; 220/4.22, 4.23, 4.24, 315, 323, 324, 350, 220/737, 829
See application file for complete search history.

(56) References Cited

U.S. PATENT DOCUMENTS

| | | | | |
|---|---|---|---|---|
| 2,161,691 | A * | 6/1939 | Anderson | 403/329 |
| 2,624,451 | A * | 1/1953 | Ewing | 206/541 |
| 3,009,227 | A * | 11/1961 | Ryan | 24/616 |
| 3,251,110 | A * | 5/1966 | Hedu | 24/616 |
| 4,100,616 | A * | 7/1978 | Wilson | 366/213 |
| 4,150,464 | A * | 4/1979 | Tracy | 24/313 |
| 4,497,581 | A | 2/1985 | Miller | |
| 6,817,751 | B2 * | 11/2004 | Huckby et al. | 366/217 |
| 2003/0142583 | A1 * | 7/2003 | Santospago et al. | 366/209 |
| 2005/0195685 | A1 * | 9/2005 | Marshall et al. | 366/217 |
| 2006/0109740 | A1 * | 5/2006 | Huckby | 366/208 |

FOREIGN PATENT DOCUMENTS

| | | | |
|---|---|---|---|
| CA | 2555892 | * | 8/2006 |
| WO | WO 9714626 A1 | * | 4/1997 |

OTHER PUBLICATIONS

B & F Metal Products Company, advertisement of spring clips available. Internet Archive date Apr. 2003.*

(Continued)

*Primary Examiner*—David L Sorkin
*Assistant Examiner*—Andrew Janca
(74) *Attorney, Agent, or Firm*—Faegre & Benson LLP

(57) ABSTRACT

This invention provides an adapter for holding small paint containers in a paint mixer sized to hold a large paint container. The adapter has first and second shells or members that are attached to each other by a hinge. The adapter is opened to hold a small paint container inside the two shells and the shells are held together with a spring clip when the shells of the adapter are closed.

4 Claims, 6 Drawing Sheets

OTHER PUBLICATIONS

Photographs of first prior art quart adapter figures A through C, 3 pgs.
Photographs of second prior art quart adapter figures D through G, 4 pgs.
Fluid Management, Inc. product brochure for H-1 Mixer, p. 1.
Fluid Management, Inc. product brochure for H-1 Mixer showing quart adapter, p. 2.
HERO Industries S2411/S2410 Vortex Paint Mixer Operating & Instruction Manual, May 2004, pp. 1 and 10.

* cited by examiner

ADAPTER FOR PAINT MIXERS

BACKGROUND

The present invention relates generally to the field of paint mixers. More specifically, the invention relates to adapters that allow small paint containers to be used in mixers designed to mix paint in large containers.

Vortex paint mixers are well known and are used to distribute colorants added to a container of uncolored or untinted paint. In addition, paint mixers are used to mix the contents of a paint container that may have separated or settled over time. Vortex paint mixers typically are sized to mix either five and one gallon paint containers.

Paint is also available in smaller containers, such as a "quart container," that contains about one quart of paint. Paint is quart containers also needs to be mixed. Quart paint containers, however, are known to have differing shapes. Common quart paint containers include generally right circular cylinders that are similar in shape to one gallon paint containers (but without trunnions or a bail) or generally rectangular shape containers with a handle that extends from one side. When these quart sized containers are mixed in a paint mixer that is sized to mix larger containers, an adapted is needed that will releasably secure the smaller paint container in the paint mixer.

SUMMARY OF THE INVENTION

This invention provides an adapter for holding a small paint container so that the small container can be mixed in a paint mixer sized to hold a large paint container. In one embodiment of the invention, the includes first and second members that are hinged together rotatably attached to each other by a hinge. The adapter further includes a spring clip that is attached to the first member at a proximal end of the clip and is laterally biased away from the first member. The spring clip extends toward the second member. The first and second members include a longitudinal slot bounded by a bridge of material. The spring clip extends through, and is laterally constrained by the bridge on the first member. When the first and second members are rotated into a closed position, the distal end of the spring clip is capable of extending into the longitudinal slot on the second member and engaging the bridge on the second member to secure the first and second members together.

DETAILED DESCRIPTION OF THE INVENTION

A conventional gallon paint container has a generally right circular cylindrical shape with a removable lid and a pair of trunnions positioned oppositely from each other on a cylindrical surface of the gallon paint container. The pair of trunnions rotatably secure a bail disposed therebetween to provide a handle for carrying the conventional cylindrical gallon paint container.

Figure 1:
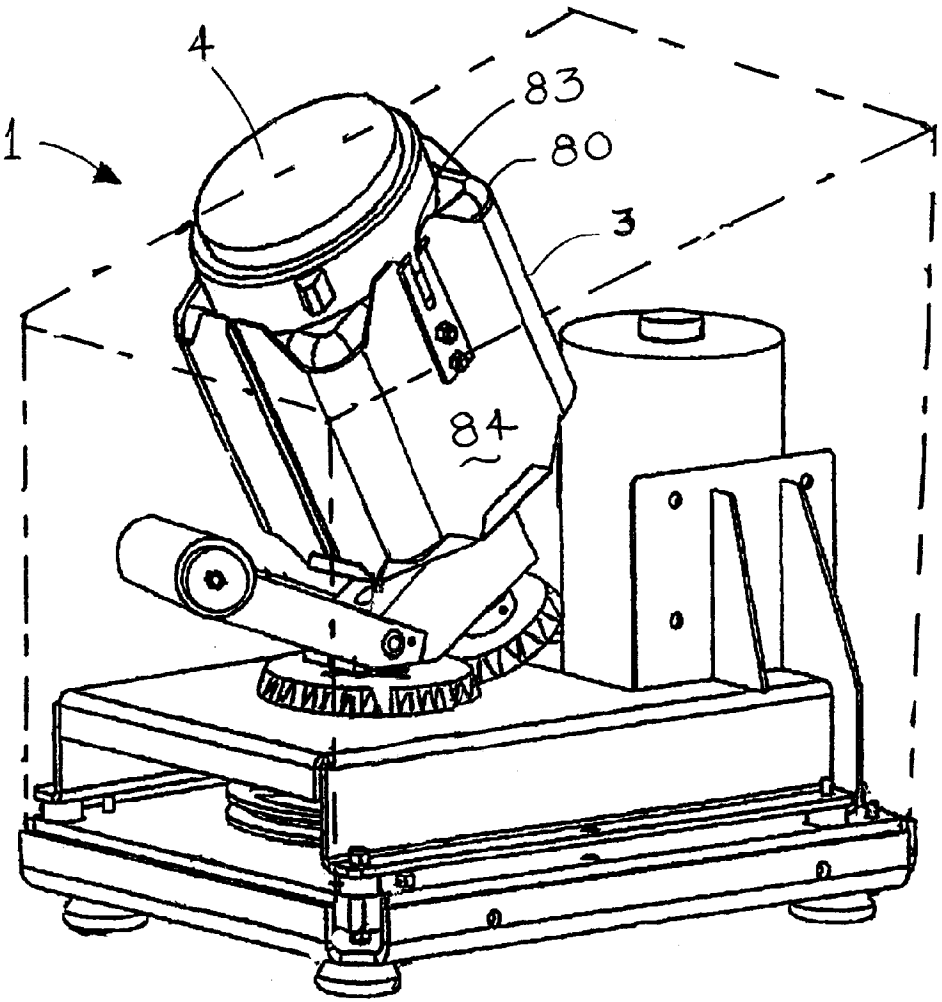
FIG. 1 is an illustration of a vortex paint mixer that holds a one gallon container.

FIG. 1 illustrates a vortex mixer 1. Vortex mixer 1 includes a mixer receptacle 3 that is configured to accept a generally rectangular paint container 4. Mixer receptacle 3 is a generally hollow container having an open end 80 on one end to accept the paint container 4 and may include pair of slots 83 (only one of which is shown extending along a wall 84 from the open end 80) and positioned to accept the trunnions of a conventional cylindrical paint container to secure the paint container and prevent it from rotating within the mixer receptacle 3 when a conventional cylindrical paint container is received in receptacle 3.

Figure 2:
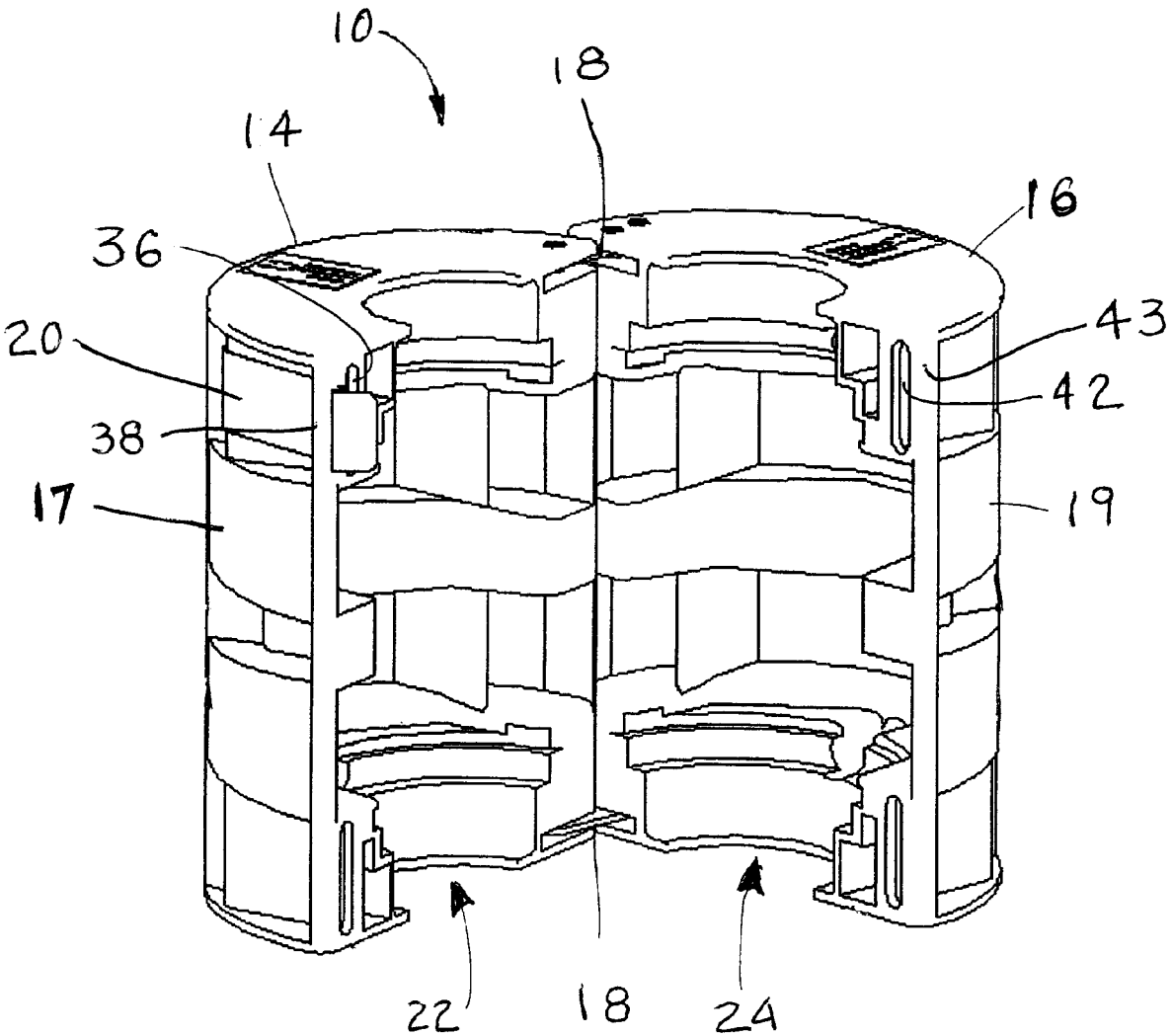
FIG. 2 is a perspective view of one embodiment of a paint mixer adapter of the present invention in an opened position.
Figure 3:
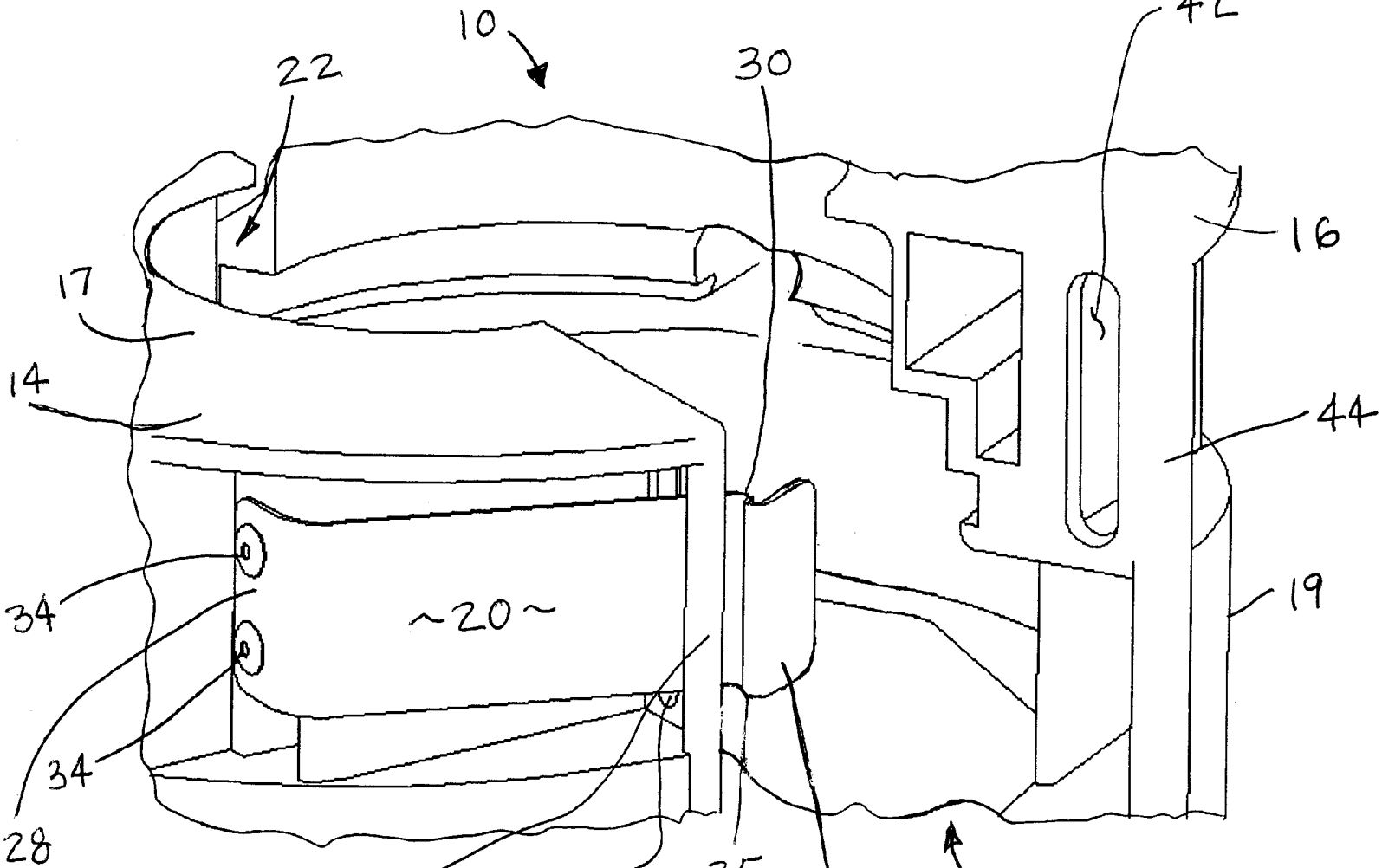
FIG. 3 is an enlarged fragmentary view of a portion of the paint mixer adapter of FIG. 2.
Figure 4:
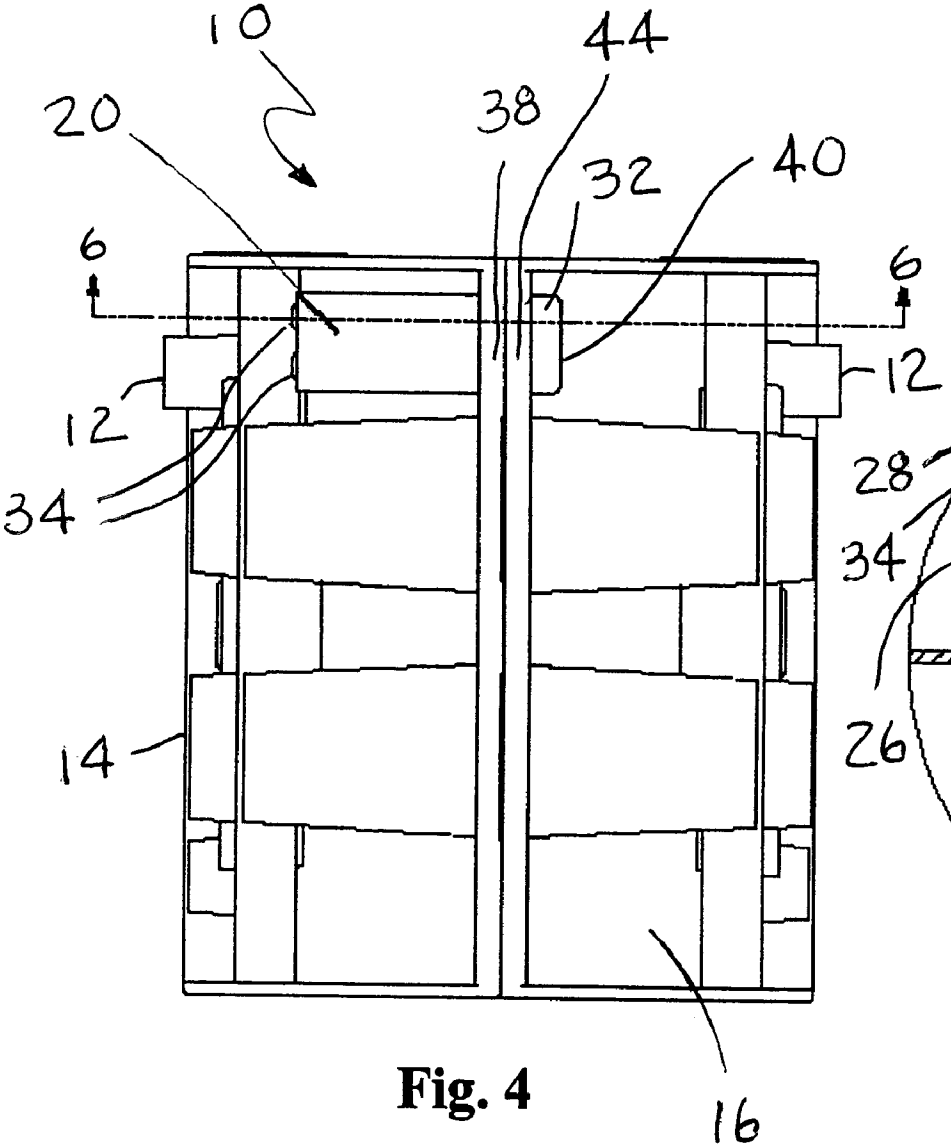
FIG. 4 is a side elevation view of the paint mixer adapter of FIG. 2 in a closed position.

FIGS. 2-5 illustrate an adapter 10 for securing a quart paint container for mounting into the mixer receptacle 3 according to one embodiment of the present invention. Adapter 10, when in a closed position as shown in FIG. 4, has a shape that approximates a generally right circular cylinder with a pair of lateral projections 12 oppositely positioned from each other that closely approximates the shape of the conventional cylindrical one gallon paint container. Adapter 10 is thus sized and shaped to fit securely within the mixer receptacle 3.

Adapter 10 has a first member 14 and a second member 16, rotatably coupled to each other by a pair of hinges 18. First and second members 14 and 16 are made of an injection molded nylon material, although other materials may be used. When in the closed position, the first member 14 and the second member 16 are releasably secured to each other with a spring clip 20, which is rigidly attached to the first member 14 and releasably secured to the second member 16 as will be described in more detail below. Outer surfaces 17 and 19 of first and second members 14 and 16, respectively, collectively define the outer envelope of the adapter 10.

FIGS. 2 and 3 show adapter 10 in an open position and reveal an inner surface 22 of the first member 14 and an inner surface 24 of the second member 16. When the adapter 10 is in the closed position, the inner surfaces 22, 24 define an inner volume configured to accept and secure either of the first quart container or the second quart container. Each of the first member 14 and the second member 16 fit within a half right circular cylinder with the exception of the lateral projection 12 that extends from their respective outer surfaces 17 and 19.

Figure 5:
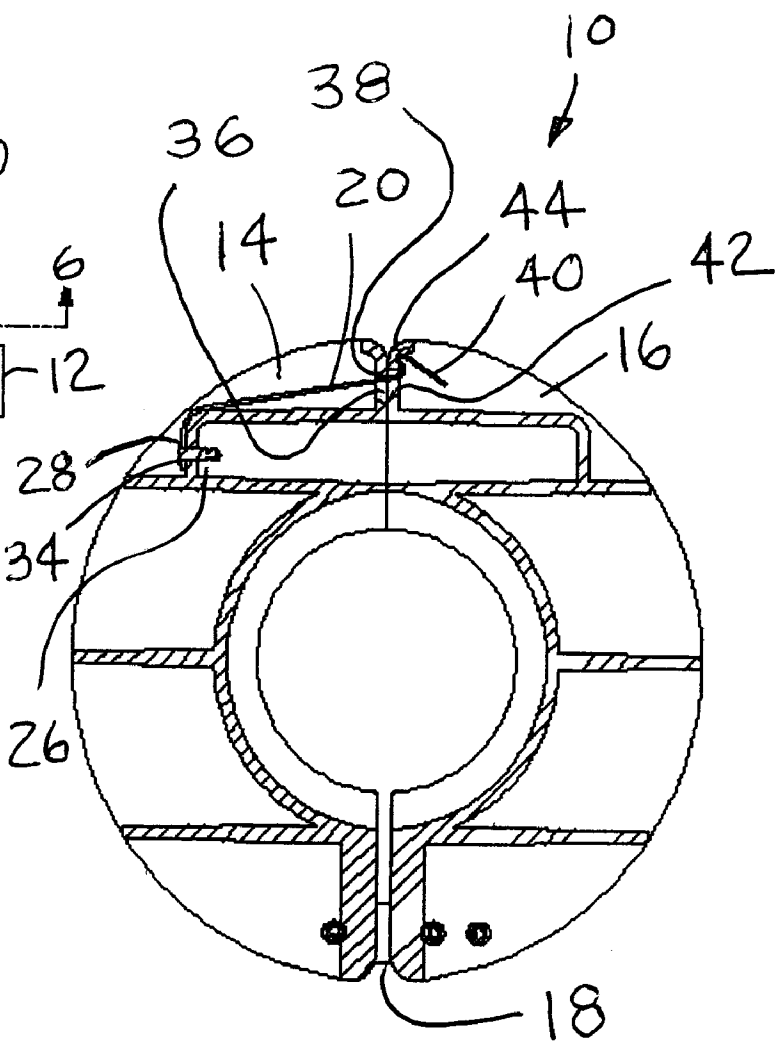
FIG. 5 is a cross-sectional view of the paint mixer adapter of FIG. 4 taken along section line 6-6 illustrating a spring clip engaged in a closed position FIG. 6. is a perspective view of a spring clip suitable for use with the paint mixer adapter of FIG. 2.
Figure 6:
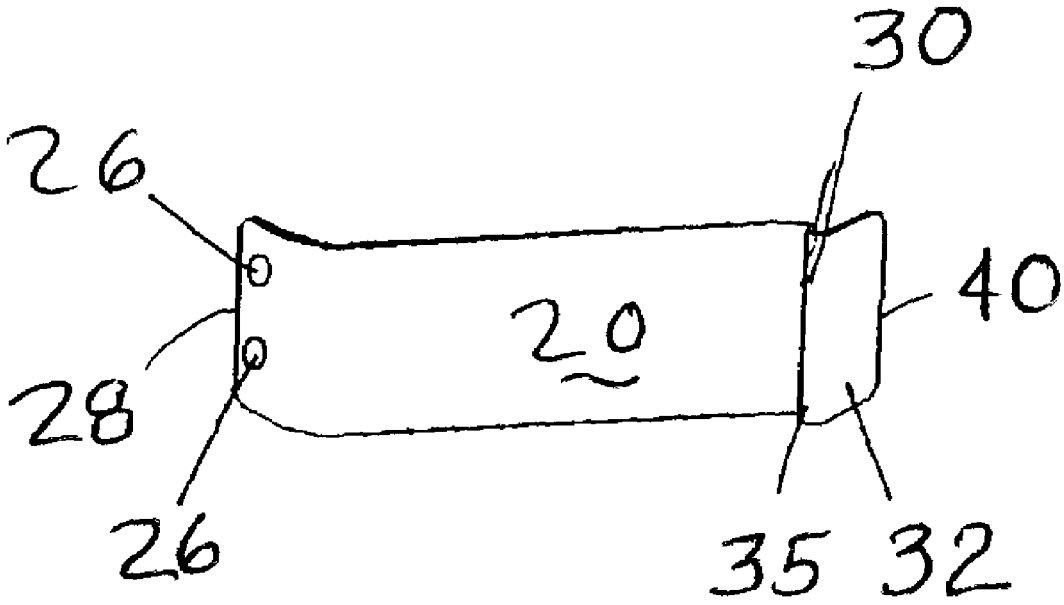

Referring to FIGS. 4-6, spring clip 20 has a pair of apertures 26 located at a proximal end 28. Apertures 26 are sized to accept fasteners 34 to secure spring clip 20 to the first member 14. The fasteners 34 can be a rivet, screw or other suitable fastener. Spring clip 20 is positioned to extend through a longitudinally oriented slot 36 bounded by a bridge 38 of material. Spring clip 20 is biased to extend laterally away from first member 14 and such that it is contained by bridge 38. Spring clip 20 has an "S-shaped" curve 35 near a distal end 40 to form a catch 30 with a tab 32 extending distally from the catch. When the spring clip 20 is attached to the first member 14, the distal end 40 extends through the slot 36 so that catch 30 and tab 32 are positioned on an opposite side of the slot from the proximal end 28 of the spring clip. Second member 16 has a longitudinally oriented slot 42 bounded by a bridge 44. Slot 42 is similarly positioned with respect to the slot 36 of the first member 14 so that when the first member and second member are rotated to a closed position (as shown in FIG. 2), the slots 36 and 42 are in alignment.

Figure 7:
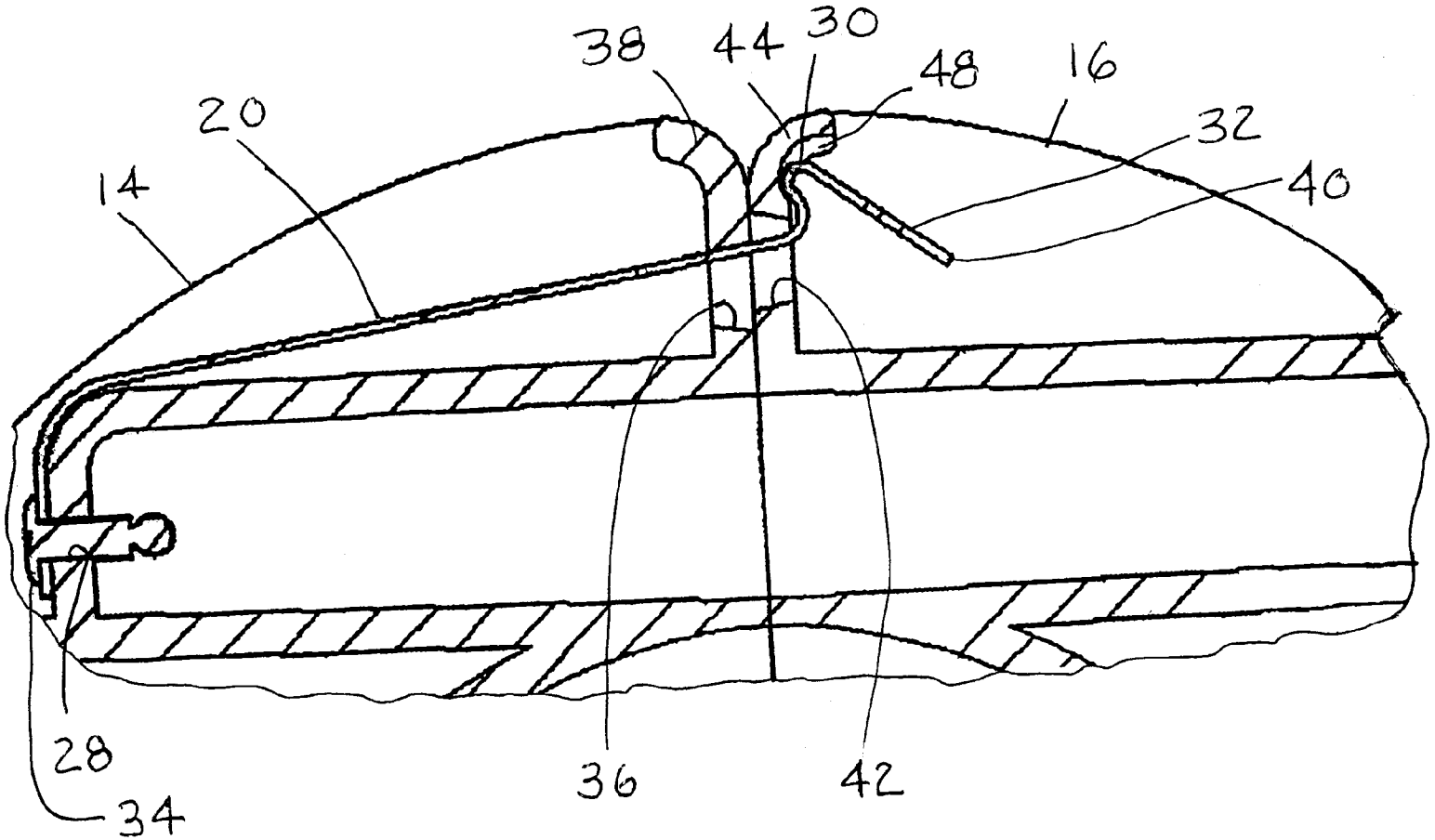
FIG. 7 is an enlarged fragmentary view of a portion of the cross-sectional view shown in FIG. 6.

Referring to FIG. 7, spring clip 20 is shown when the adapter 10 is in a closed position. Bridge 44 has an indentation 48 extending longitudinally along the bridge. The distal end 40 of spring clip 20 is fed through slot 42 on second member 16 until the catch 30 is through slot 42. Catch 30 is seated within indentation 48 to hold adapter 10 in a closed position. Tab 32 extends through the slot 42 so that it is accessible when the adapter is closed. To move the adapter from a closed to an open position a force can be applied against the tab 32 to move the catch 30 from the indentation 48 and allow the distal end 40 of the spring clip 20 to pass through the slot 42.

The present invention includes important advantages. For example, by including a spring clip to secure the adapter when it is in a closed position, the adapter is more easy to handle and prevents unintended opening of the adapter when it is being handled. Further, by restraining the clip within the bridge of material on the first member, the clip is less prone to being bent beyond its elastic limit, thereby preventing damage to the adapter.

The present invention has been described above with respect to a specific embodiment of the invention. The embodiment is for illustrative purposes only. Changes in the described embodiment may be made without departing from the scope of the invention. For example, other shapes of quart containers may be accommodated inside the adapter. In addition, the first and second members need not be formed from the same mold and therefore need not be substantially identical.

What is claimed:

1. An adapter to hold a small paint container in an interior of the adapter and having an exterior shaped to be held in a paint mixer sized to hold a large paint container, the adapter comprising:

a first member fitted with spring clip attached to the first member at a proximal end of the clip and having a distal end of the clip shaped to define a catch, where the distal end of the spring clip is biased outward from the first member and extends through a first longitudinal slot on the first member bounded by a first bridge positioned to constrain outward movement of the spring clip; and a second member hinged to the first member and having a second longitudinal slot on the second member bounded by a second bridge positioned to be aligned with the first longitudinal slot when the first and second members are rotated to be in close proximity to each other so that the distal end of the spring clip extends into the second longitudinal slot and engages the second member to secure the first member to the second member wherein the second bridge includes a depression shaped to accept the catch of the spring clip when the spring clip is extended into the second longitudinal slot and the interior of the adapter is shaped to hold one of a conventional cylindrical quart container or a rectangular or square quart container.

2. The adapter of claim 1 wherein the spring has a generally S-shaped curve near the distal end thereof.

3. The adapter of claim 2 wherein the generally S-shaped curve forms the catch.

4. The adapter of claim 1 wherein the first bridge limits movement of the distal end of the spring to remain within an elastic limit range of the spring.

* * * * *